US006615883B2

(12) United States Patent
Vincent, III et al.

(10) Patent No.: US 6,615,883 B2
(45) Date of Patent: Sep. 9, 2003

(54) CONTAINER HAVING SPLINES AND METHOD FOR USING SAME

(75) Inventors: John J. Vincent, III, Bethlehem, PA (US); Douglas A. Abbott, Easton, PA (US); Daniel L. King, Wantage, NJ (US)

(73) Assignee: Pechiney Plastic Packagaing, Inc., Chicago, IL (US)

( * ) Notice: Subject to any disclaimer, the term of this patent is extended or adjusted under 35 U.S.C. 154(b) by 0 days.

(21) Appl. No.: 10/101,022

(22) Filed: Mar. 19, 2002

(65) Prior Publication Data

US 2003/0106612 A1 Jun. 12, 2003

Related U.S. Application Data

(60) Provisional application No. 60/338,872, filed on Dec. 7, 2001.

(51) Int. Cl.[7] ..... B65B 1/04

(52) U.S. Cl. ..... 141/383; 141/364; 141/319

(58) Field of Search ..... 222/92, 575; 141/383, 141/384, 364, 365, 366, 319

(56) References Cited

U.S. PATENT DOCUMENTS

| | | | | |
|---|---|---|---|---|
| 1,690,654 A | | 11/1928 | Trotter | |
| 2,773,521 A | * | 12/1956 | Persson | 141/5 |
| 3,261,381 A | | 7/1966 | Roach | |
| 3,330,312 A | | 7/1967 | Parady | |
| 4,023,602 A | | 5/1977 | Sparr, Sr. | 141/311 |
| 4,307,763 A | | 12/1981 | Wang | 141/364 |
| 4,506,783 A | | 3/1985 | Morganroth | 206/581 |
| 4,627,476 A | | 12/1986 | Wilcke | 141/364 |
| 5,490,545 A | * | 2/1996 | Sokoloff et al. | 141/319 |
| 5,505,235 A | | 4/1996 | Gorokhovsky et al. | 141/319 |
| 5,533,553 A | | 7/1996 | Vesborg | 141/319 |
| 5,551,454 A | | 9/1996 | Goncalves | 132/208 |
| 5,823,387 A | * | 10/1998 | Manadanas et al. | 222/1 |
| 5,884,678 A | | 3/1999 | Chudy | 141/319 |
| 6,176,395 B1 | | 1/2001 | Abbott et al. | 222/94 |

* cited by examiner

*Primary Examiner*—Steven O. Douglas
(74) *Attorney, Agent, or Firm*—Ohlandt, Greeley, Ruggiero & Perle, LLP

(57) ABSTRACT

Disclosed is a container for receiving contents from another container. The container has a receptacle and a head. The receptacle has a chamber therein. The head has a neck. The neck has a receiving orifice therein and a bore therethrough. The receiving orifice communicates with the chamber through the bore. The neck further has an inner surface contiguous to the receiving orifice and/or the bore. The inner surface has a plurality of splines extending therefrom and generally directional to the longitudinal extension of the neck. Further disclosed is a tube container. Still further disclosed is a method for introducing the contents of one container into another container.

13 Claims, 5 Drawing Sheets

CONTAINER HAVING SPLINES AND METHOD FOR USING SAME

This Application claims the benefit of Provisional Application Ser. No. 60/338,872 filed on Dec. 7, 2001.

BACKGROUND OF THE INVENTION

1. Field of the Invention

The present invention is related to a container having splines to enhance the transfer of contents from another container. More particularly, the present invention relates to a tube container having splines. Still more particularly, the present invention relates to a method for transferring the contents of one container to another container.

2. Description of the Prior Art

Containers, including tube containers, have been employed in the art to hold and dispense products in various forms, such as liquids, gels, pastes, powders, ointments and creams.

In certain commercial applications, it has been necessary to transfer the contents of one container into another. A common application requiring such a transfer is hair coloring, which usually requires the transfer of one reactive component from one container to another container holding a second reactive component. The reactive components are admixed and permitted to react to form the coloring composition, which is then applied to the hair. Container means for effecting transfer of hair coloring compositions are seen by way of example in U.S. Pat. Nos. 4,506,783 and 5,551,454.

A problem commonly encountered in transfer of contents from one container to another is spillage by the consumer. The device proposed in U.S. Pat. No. 5,551,454 employs a means in which an external thread of the dispensing container is mated with an internal thread of the receiving container. While effective in preventing spillage, the device does not permit venting of gases from the receiving container during transfer of contents. Venting of gases affords more efficient transfer. Further, the manufacture of a receiving container with an internal thread may be relatively difficult and expensive.

The device proposed in U.S. Pat. No. 4,506,783 likewise reduces spillage, but presents disadvantages. The device employs a flexible bag of bleaching powder within a rigid container. Developer is introduced into the bag through a small orifice. Although the potential for spillage is reduced, the device is relatively complicated and the powder/developer mixture may be difficult to remove from the rigid container.

U.S. Pat. Nos. 3,261,381 and 5,884,678 propose an internally threaded connector to receive externally threaded containers at opposite ends. The disadvantages of this connector are similar to those seen in the device disclosed in U.S. Pat. No. 5,551,454. Venting of gases during transfer of contents may not be possible. Further, the connector would add additional cost.

U.S. Pat. No. 5,533,553 proposes a receiving container and a dispensing container having guide faces that permit them to be coupled. While effective in preventing spillage, the coupling does not permit venting of gases from the receiving container. Moreover, the guide faces are relatively complicated and may be difficult to manufacture.

It would be desirable have a container for receiving contents from a dispensing container. It would further be desirable to have a receiving container that affords secure joinder and coupling with a dispensing container. It would further be desirable to have a receiving container that is adapted to receive a dispensing container having a neck with external threads. It would further be desirable to have a receiving container in the form of a tube. It would further be desirable to have a receiving container that permits the venting of gases when contents from another container are being dispensed therein. It would still further be desirable to have a receiving container that is relatively simple in design and economical to manufacture.

SUMMARY OF THE INVENTION

According to the present invention, there is a container for receiving contents from another container. The container has a receptacle and a head. The receptacle has a chamber therein. The head has a neck. The neck has a receiving orifice therein and a bore therethrough. The receiving orifice communicates with the chamber through the bore. The neck further has an inner surface contiguous to the receiving orifice and/or the bore. The inner surface has a plurality of splines extending therefrom and generally directional to the longitudinal extension of the neck.

Further according to the present invention, there is a tube container. The tube container has a body wall, which defines a chamber. The tube container also has a head, which has a neck and a shoulder. The shoulder communicates between the neck and the body wall. The neck has a receiving orifice therein and a bore therethrough. The receiving orifice communicates with the chamber through the bore. The neck further has an inner surface contiguous to the receiving orifice and/or the bore. The inner surface has a plurality of splines extending therefrom and generally directional to the longitudinal extension of the neck.

Still further according to the present invention, there is a method for introducing the contents of one container into another container. The comprises the following: a) providing a first container according to the container described above; b) providing a second container; and c) inserting the second neck of the second container into the orifice of the first container and permitting the contents to empty into the first container. The splines are made of a plastic. The second container has a second chamber and contents in the chamber. The second container has a second neck, which has a second orifice therein and a second bore therethrough. The second orifice is in communication with the second chamber through the second bore. The second neck has a second outer surface defining threads adapted to be received by the splines of the first container. The threads of the second neck are made of a metal harder than the plastic of the splines.

DETAIL DESCRIPTION OF THE INVENTION

It was found surprising that a receiving container for receiving contents from a dispensing container afforded secure joinder and coupling with the dispensing container. The receiving container will also permit the venting of gases when contents from a dispensing container are being dispensed therein. The receiving container can be adapted to receive a dispensing container having a neck with external threads. The receiving container can also be made in the form of a tube. The receiving container is also relatively simple in design and economical to manufacture.

Figure 1:
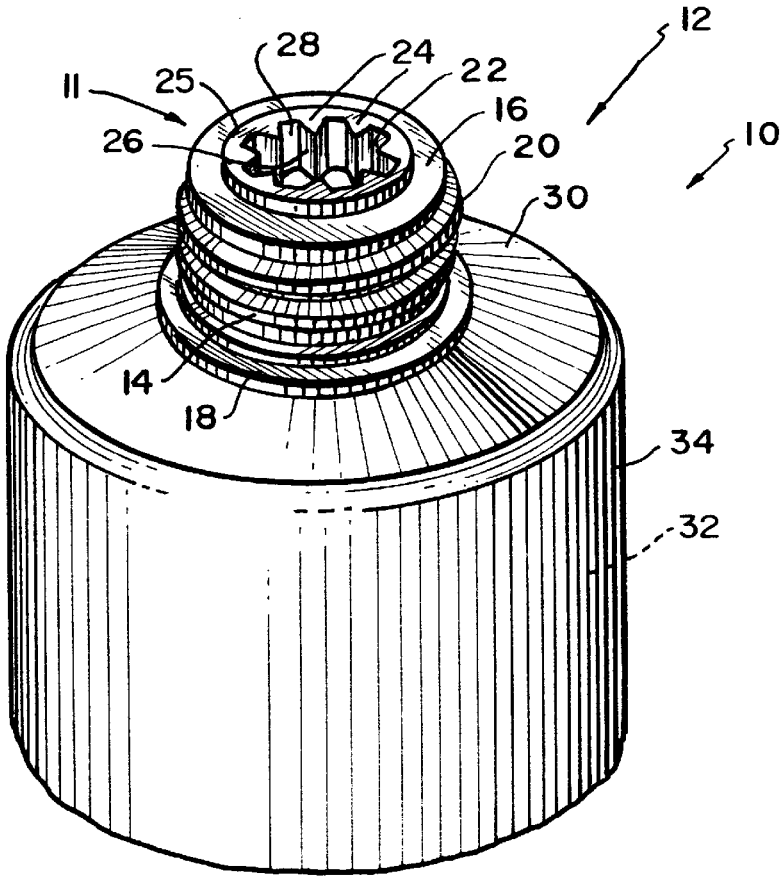
FIG. 1 is an isometric view of a tube container according to the present invention.
Figure 2:
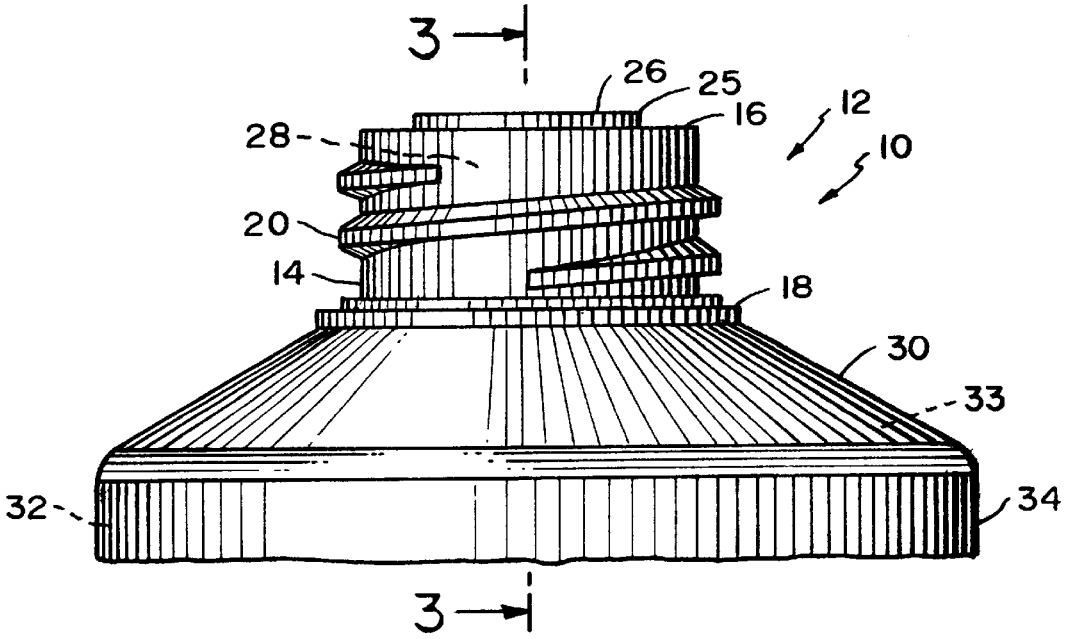
FIG. 2 is an enlarged front view of an upper portion of the container of FIG. 1.
Figure 3:
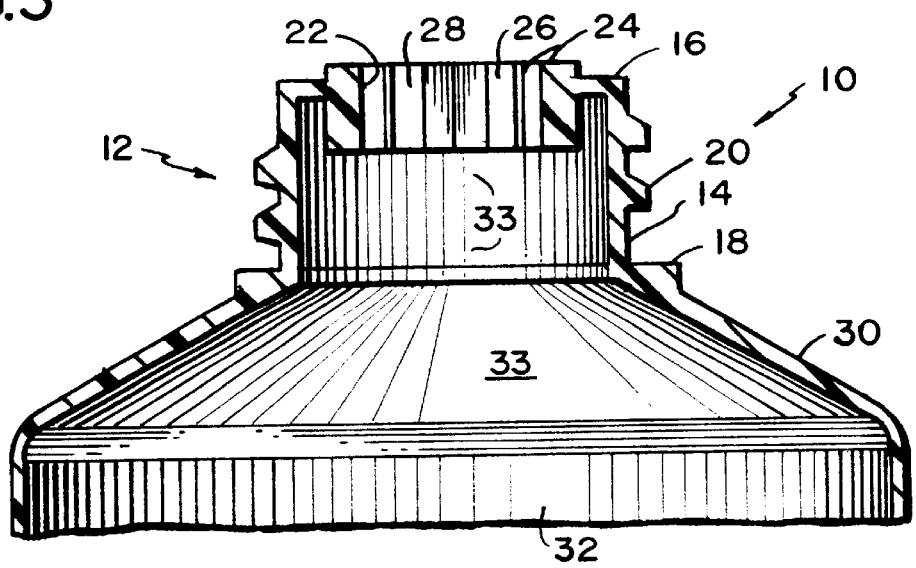
FIG. 3 is a cross-sectional view taken along a line 3—3 in FIG. 2.
Figure 4:
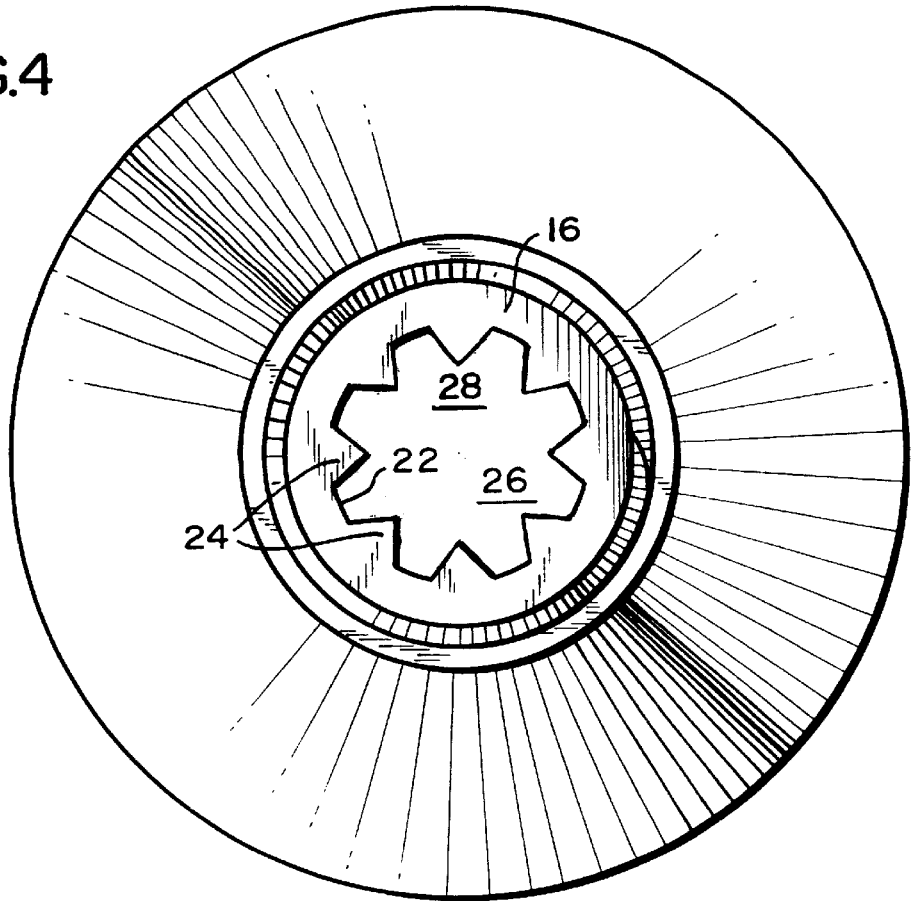
FIG. 4 is an enlarged top view of the container of FIG. 1.

FIG. 1 shows an embodiment of the tube container of the present invention and is generally designated by reference numeral 10. Tube container 10 has a body wall 34, which defines a chamber 32 therein. Tube container 10 also has a head 11, which has a neck 12 and a shoulder 30. Shoulder 30 communicates between and joins neck 12 and body wall 34. Shoulder 30 has a land portion 18, which is situated at the interface of neck 12 and shoulder 30. As shown in FIG. 3, neck 12 and shoulder 30 define an antechamber 33 therein. Neck 12 has an outer neck 14 and a receiver neck 25. Neck 12 further has a seat 12 that communicates between and joins outer neck 14 and receiver neck 25. Receiver neck 25 has a receiving orifice 26 therein and a bore 28 therethrough. As shown in FIG. 2, outer neck 14 has exterior threads 20 that are adapted to receive threads from a cap (not shown). Receiving orifice 26 communicates with antechamber 33 and chamber 32 through bore 28. Receiver neck 25 further has an inner surface 22 that bounds and defines the configuration of receiving orifice 26 and bore 28. As shown in FIG. 4, inner surface 22 defines a plurality of splines 24 extending therefrom in a spaced-apart relationship circumferentially around receiving orifice 26 and bore 28 and along bore 28. As shown in FIGS. 1 and 3, splines 24 extend generally directional to the longitudinal extension of receiver neck 25.

Figure 6:
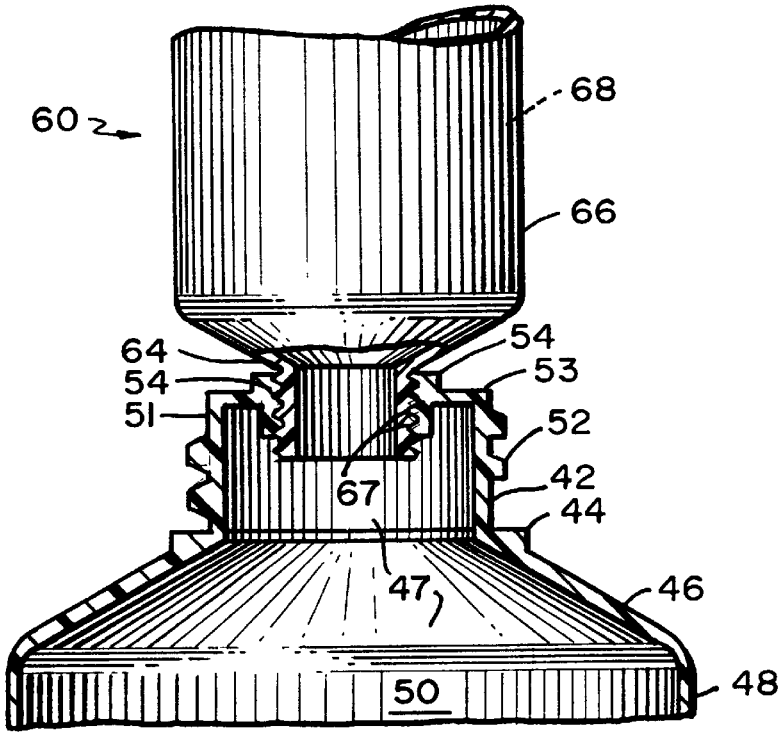
FIG. 6 is a cross-sectional view taken along a line 6—6 in FIG. 5.
Figure 7:
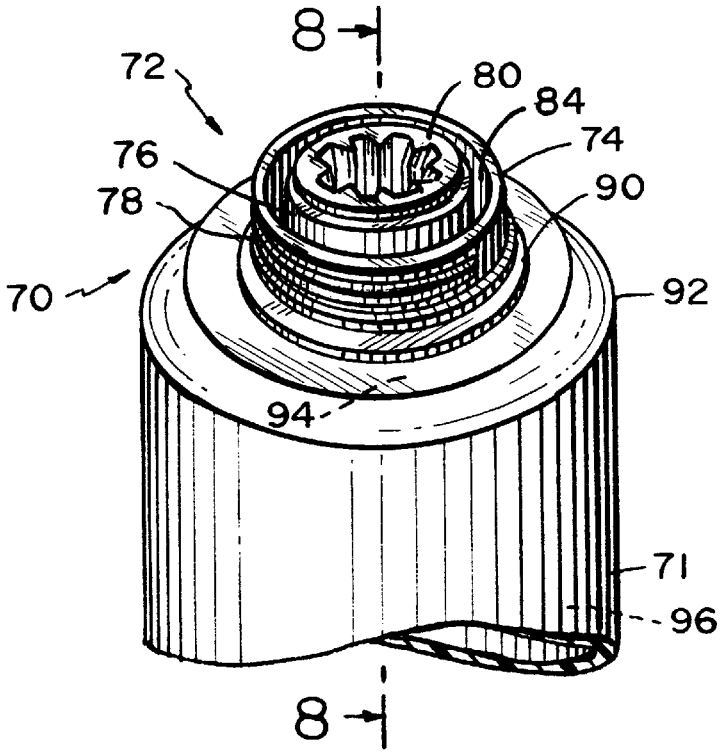
FIG. 7 is an isometric view of another embodiment of a tube container according to the present invention.
Figure 8:
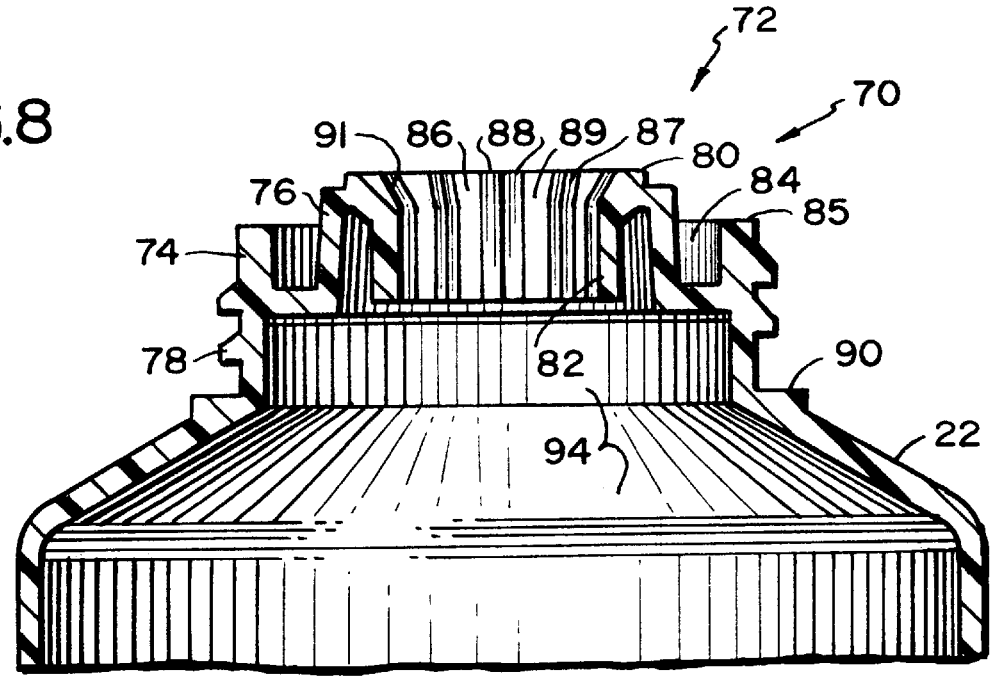
FIG. 8 is a cross-sectional view of an upper portion of the container of FIG. 7 taken along a line 8—8.

A preferred embodiment of tie tube container of the present invention is seen in FIG. 7 and is generally designated by reference numeral 70. Tube container 70 has a body wall 71, which defines a chamber 96 therein. Tube container 70 also has a head 72, which has an outer neck 74, an inner neck 76, a receiver neck 82 and a shoulder 92. Shoulder 92 communicates between and joins outer neck 74 and body wall 71. Shoulder 92 has a land portion 90, which is situated at the interface of outer neck 74 and shoulder 92. Inner neck 76 communicates between and joins outer neck 74 and receiver neck 82 at seat 80. Inner neck 76 and outer neck 74 adjoin to form a circumferential cavity 84 outside inner neck 76. Outer neck 74 has exterior threads 78 that are adapted to receive threads from a cap (not shown). As shown in FIG. 8, outer neck 74 and shoulder 92 define an antechamber 94 therein. Receiver neck 82 has a receiving orifice 87 therein and a bore 89 therethrough. Receiving orifice 87 communicates with antechamber 94 and chamber 96 through bore 89. Receiver neck 82 further has an inner surface 86 that bounds and defines the configuration of receiving orifice 87 and bore 89. Inner surface 86 defines a plurality of splines 88 extending therefrom in a spaced-apart relationship circumferentially around receiving orifice 87 and around and along bore 89. Splines 88 extend generally directional to the longitudinal extension of receiver neck 82. Inner surface 86 also has a tapered surface 91 that extends outward from and circumferentially around receiver neck 82 in proximity to receiving orifice 87. Tapered surface 91 affords easier access to receiving neck 82 and receiving orifice 87 by the neck of a dispensing container such as the one shown in FIGS. 5 and 6.

Figure 9:
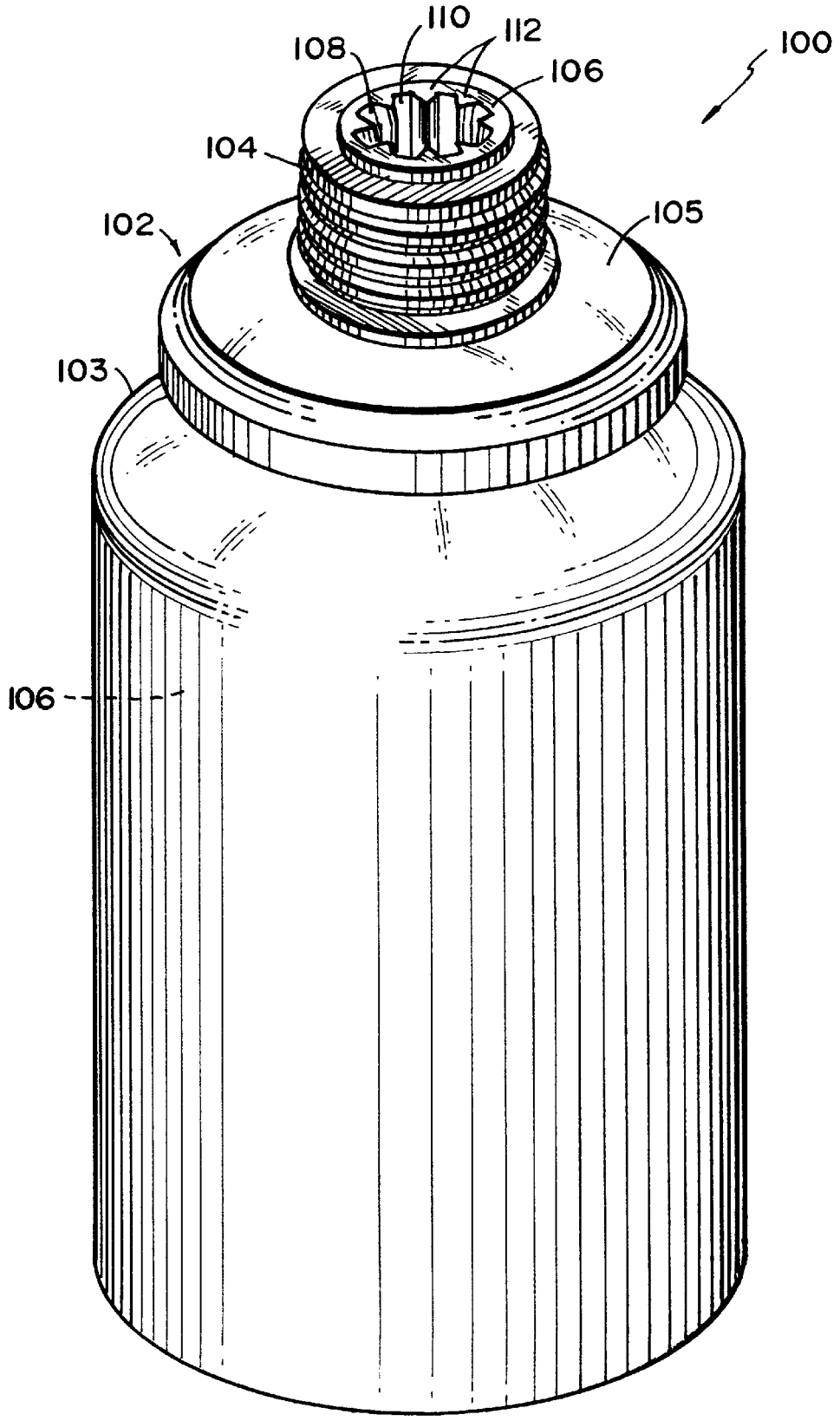
FIG. 9 is an isometric view of another embodiment of a container according to the present invention.

The container of the present invention may be more generally described as container 100 shown in FIG. 9. Container 100 has a receptacle 103 that defines a chamber 106 therein. Container 100 has a head 102. Head 102 comprises a cylindrical neck 104 and a shoulder 105. Neck 104 has a receiving orifice 106 therein and a bore 108 therethrough. Receiving orifice 106 in communication with chamber 106 through bore 108. Neck 104 further has an inner surface 110 contiguous to and bounding around receiving orifice 106 and bore 108. Inner surface 110 has a plurality of splines 112 extending therefrom and generally directional to the longitudinal extension of neck 104.

Figure 5:
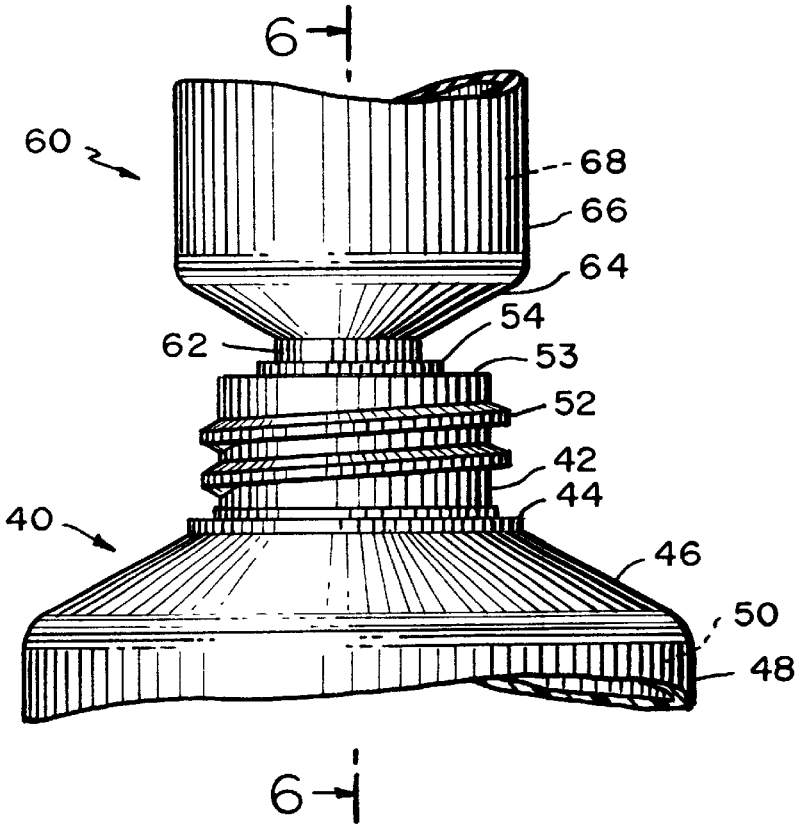
FIG. 5 is a front view of an engaged and interlocking receiving and dispensing containers in accordance with the present invention. The receiving and dispensing containers are shown in fragmentary view.

The method of the present invention for introducing the contents of one container into another container is illustrated in FIGS. 5 and 6. Generally, the external threads 67 of a dispensing container 60 are screwed into a receiving neck 54 of a receiving container 40 having splines therein (obscured in FIGS. 5 and 6) of the same configuration as shown in FIGS. 7 and 8. The contents (not shown) of dispensing container 60 flow into receiving container 40 either both force of gravity and/or mechanical manipulation of dispensing container 60, e.g. shaking or squeezing. The contents flow from a dispensing chamber 68. through dispensing orifice 63 in dispensing neck 62 into receiving orifice 55 in receiving neck 54 into receiving chamber 50. As the contents flow from the dispensing container 60 into receiving container 40, displaced air or gas within receiving container 40 is vented to the atmosphere along and in between individual threads in external threads 67 of dispensing container 60. Other features of dispensing container 60 are dispensing body wall 66 and dispensing shoulder 64, which communicate and join with dispensing neck 62 in sequence. Other features of receiving container 40 are receiving body wall 48 and receiving shoulder 46, which communicate and join with outer neck 42 in sequence. The interface of shoulder 46 and outer neck 42 defines land portion 44. Outer neck 42 communicates and joins with receiving orifice 55 through seat 53.

An advantageous feature of the method of the present invention is the venting of air or gases that occurs when the contents of the dispensing container are being transferred to the receiving container. As volume within the receiving container is displaced by the contents, air or gases within the receiving container vents to the atmosphere between and along the external threads of the dispensing container and the splines of the receiving container.

The method of the present invention is useful in forming a hair color composition and treating hair. A bleaching powder can be admixed with a liquid developer to form the composition. The bleaching powder can be transferred from a dispensing container to a receiving container having the fluid developer to form a hair coloring composition. Alternately, the fluid developer can be transferred from a dispensing container to a receiving container having the bleaching powder. The composition is applied to the hair for a period of time sufficient to obtain the desired level of lightening or coloring. The composition is then washed from the hair. Additional teachings to methods for forming hair color compositions are provided in U.S. Pat. No. 5,551,454 which is incorporated herein by reference.

The present invention may be adapted to receiving containers other than those of tubular shape or configuration. Splines may simply be adapted to the orifice or orifices of a receiving container of any shape, such as the bottle-shaped container depicted in FIG. 9.

The splines of the container of the present invention are comprised of a plastic. It is important for the splines to be of a plastic so that the they will be self-threading, i.e. will be threaded when the externally threaded neck of the dispensing container is screwed into the receiving orifice of the receiving container. The threads of the neck of the dispensing container are comprised of a material that is harder than the plastic of the splines so that the threads of the neck will thread the splines. The external threads of the dispensing container are said to "thread" the splines in that they burrow into or deform the splines as they enter the receiving orifice and/or bore. The external threads screw into the splines. The plastic of the splines may be comprised of any plastic known in the packaging art such as ethylene polymers, propylene polymers, polyethylene terephthalate and polyamides. Useful ethylene polymers include low density polyethylene, medium density polyethylene, high density polyethylene and linear low density polyethylene and mixtures thereof. A useful propylene polymer is polypropylene.

The portions of the receiving container other than the splines may be comprised of any material known in the packaging art, such as plastics, metals, glass and the like. Preferably, the neck and the entire receiving container will be comprised of a plastic, most preferably the same as that of the splines. Useful plastics include those described above for the splines.

The external threads of the dispensing container may be comprised of any material harder than the plastic comprising the splines. Useful materials include plastics, metals, glass, ceramics, and the like. If the external threads are of a plastic, then that plastic must be harder than the plastic of the splines. Preferably, the external threads of the dispensing container are comprised of a metal, such as aluminum or steel. Aluminum is preferred.

The portions of the dispensing container other than the external threads may be comprised of any material known in the packaging art, such as plastic, metals, glass and the like. Preferably, the neck and the entire dispensing container will be comprised of a metal, most preferably the same as that of the external threads of the dispensing container. Useful metals include those described above for the external threads of the dispensing container.

Tube containers may be produced by any method known in the art such as extrusion or lamination. In extrusion, a plastic tube is extruded continuously then cut into discrete lengths that form the body wall of the tube. A tube head is then heat welded or adhered to one end of a tube length and a cap or top is applied to the head. The other open end of the tube length is typically filled with product to be dispensed and then sealed by heat or mechanical means. In lamination, a sheet of plastic or composite such as plastic/metal is rolled to a tubular shape and sealed along the sheet edges to form a continuous tube. The tube is cut into discrete lengths, head and cap applied, filled with product at the open end, and end sealed in the same manner as an extruded tube.

Tube heads, including the portions thereof having splines, may be formed by any means known in the art, such as injection molding. Tube heads having splines with tapered surfaces adjacent the orifice can be formed by using injection molding tooling of tapered configuration at the desired position of taper or by using injection molding tooling of non-tapered configuration at the desired position of taper and utilizing natural shrinkage of plastic melt upon cooling.

It should be understood that the foregoing description is only illustrative of the present invention. Various alternatives and modifications can be devised by those skilled in the art without departing from the invention. Accordingly, the present invention is intended to embrace all such alternatives, modifications and variances which fall within the scope of the appended claims.

What is claimed is:

1. A method for introducing the contents of one container into another container, comprising:

a) providing a receiving container having a receiving body wall, the receiving body wall defining a receiving chamber therein, the receiving container having a receiving head, the receiving head comprising a receiving neck and a receiving shoulder which communicates between the receiving neck and the receiving body wall, the receiving neck having a receiving orifice therein and a receiving bore therethrough, the receiving orifice being in communication with the receiving chamber through the receiving bore, the receiving neck further having a receiving inner surface contiguous to the receiving orifice and/or the receiving bore, the receiving inner surface having a plurality of splines extending therefrom and generally directional to the longitudinal extension of the receiving neck, the splines being made of a plastic;

b) providing a dispensing container, the dispensing container defining a dispensing chamber, the dispensing chamber having contents therein, the dispensing container having a dispensing neck having a dispensing orifice therein and a dispensing bore therethrough, the dispensing orifice being in communication with the dispensing chamber through the dispensing bore, the dispensing neck having a dispensing outer surface defining threads adapted to be received by the splines of the receiving container, the threads being of a material harder than the plastic of the splines;

c) inserting the dispensing neck of the dispensing container into the receiving orifice of the receiving container and emptying the contents into the receiving container.

2. The method of claim 1, wherein the dispensing neck of the dispensing container is screwed into the receiving orifice and receiving bore of the receiving container.

3. The method of claim 2, wherein the material is a metal.

4. The method of claim 2, wherein the receiving container has a fluid developer therein and the contents of the dispensing container comprise a bleaching powder, the fluid developer and the bleaching powder being combined to form a hair coloring composition.

5. The method of claim 2, wherein the splines are positioned circumferentially around the inner surface, and wherein the neck has from 4 to 24 splines, and wherein the material is a metal.

6. The method of claim 1, wherein the splines are positioned circumferentially around the inner surface.

7. The method of claim 1, wherein the neck has from 2 to 24 splines.

8. The method of claim 1, wherein the neck has from 4 to 24 splines.

9. The method of claim 1, wherein the neck has from 8 to 20 splines.

10. The method of claim 1, wherein the material is a metal.

11. The method of claim 1, wherein the metal is aluminum.

12. The method of claim 1, wherein the plastic is an ethylene polymer or a propylene polymer.

13. The method of claim 1, wherein the receiving container has a fluid developer therein and the contents of the dispensing container comprise a bleaching powder, the fluid developer and the bleaching powder being combined to form a hair coloring composition.

* * * * *